United States Patent [19]

Dettelbach et al.

[11] 4,418,640

[45] Dec. 6, 1983

[54] APPLICATOR FOR APPLYING ADHESIVE TO A WORK PIECE

[75] Inventors: Alfred Dettelbach, Stuttgart; Roland Henzler, Nuertingen-Raidwangen, both of Fed. Rep. of Germany

[73] Assignee: Reich Spezialmaschinen GmbH, Nuertingen, Fed. Rep. of Germany

[21] Appl. No.: 366,051

[22] Filed: Apr. 6, 1982

[30] Foreign Application Priority Data

Apr. 16, 1981 [DE] Fed. Rep. of Germany ..... 3115418

[51] Int. Cl.[3] ..... B05C 5/02

[52] U.S. Cl. ..... 118/411; 222/148; 239/110

[58] Field of Search ..... 118/410, 411; 239/110; 222/148, 331, 486

[56] References Cited

U.S. PATENT DOCUMENTS 3,753,529 8/1973 Baker ..... 239/110
3,921,905 11/1975 McElhoe et al. ..... 239/110
4,178,876 12/1979 Nicklas et al. ..... 118/411 X

FOREIGN PATENT DOCUMENTS 2731799 1/1979 Fed. Rep. of Germany ..... 118/410

*Primary Examiner*—John P. McIntosh
*Attorney, Agent, or Firm*—W. G. Fasse; D. H. Kane, Jr.

[57] ABSTRACT

The applicator for applying adhesive to a work piece, for example in an edge glueing machine for work pieces moving continuously through the machine, has adhesive discharge holes (6). The adhesive is supplied through these holes (6) under pressure to the edge of work pieces. Any contaminating particles, which may be present in the adhesive prior to its application to the work piece, tend to travel upwardly with the adhesive in the adhesive supply conduit (2, 4), due to their lower specific weight, whereby the contaminations may clog the discharge holes (6) and prevent the proper application of adhesive to a work piece. For avoiding such clogging the nozzle body (1) is provided with a scavenging duct (5) which is connectable to the adhesive supply conduit (2, 4) for repeatedly passing a portion of adhesive out of the supply conduit (4), whereby the application of adhesive may be performed without any trouble. The discharge holes (6) are closed during the scavenging of a small portion of adhesive. Preferably the scavenging duct portion (5') is connected to the supply conduit at a location above the adhesive discharge holes (6).

6 Claims, 4 Drawing Figures

APPLICATOR FOR APPLYING ADHESIVE TO A WORK PIECE

BACKGROUND OF THE INVENTION

The present invention relates to an applicator for applying adhesive to a work piece, especially in edge glueing machines. In such applicators the adhesive may be supplied to the surface of a nozzle body through a row of applicator holes which may be opened and closed by a slide valve. In a first position of the slide valve the adhesive supply conduit is connected to the adhesive discharge holes. In a second position the holes are closed.

German Patent Application (DE-OS) No. 27 31 799 corresponding to U.S. Pat. No. 4,178,876 discloses such an applicator. The known applicator cooperates with a melting chamber in which a meltable adhesive in the form of a cylindrical cartridge or in the form of granular material is melted adjacent to a heatable facing melting wall forming a part of the melting chamber. There are holes in the melting wall and the adhesive is maintained under pressure for passing the molten adhesive through these holes into a nozzle body of the applicator proper. The applicator is provided with the adhesive discharge holes through which the adhesive is supplied to the narrow edge of a plate shaped work piece.

In the known melting and applicator device according to German Patent Application No. 27 31 799 corresponding to U.S. Pat. No. 4,178,876; issued on Dec. 18, 1979, it is possible that contaminations present in the meltable adhesive, such as small bodies not forming part of the adhesive or dirt particles, may be freed during the melting. These particles or bodies have a smaller specific weight than the adhesive and therefore have a tendency to travel into the adhesive supply conduit of the nozzle body. Once these contaminating elements are in the supply conduit, they have a tendency to clog the adhesive discharge holes, thereby preventing that the adhesive is properly applied to the work piece. If this happens, the bonding between the work piece and the respective edge strip is impaired.

OBJECTS OF THE INVENTION

In view of the above it is the aim of the invention to achieve the following objects singly or in combination:

- to provide an applicator for applying adhesive to the edge of a work piece in which any contaminations may be removed from the applicator prior to the application of any adhesive to a work piece to thereby prevent any clogging of the adhesive discharge holes;
- to provide an adhesive applicator especially for edge glueing machines, by means of which the adhesive may be applied free of any faults to assure a clean adhesive bond;
- to provide for a repeated scavenging or rinsing of the adhesive applicator while simultaeously minimizing any waste of adhesive; and
- to provide an adhesive applicator, which is suitable for use in connection with any type of adhesive including those which are solid or liquid at room temperature.

SUMMARY OF THE INVENTION

The invention provides an applicator for applying adhesive to work pieces especially in edge glueing machines through which the work pieces travel in a continuous manner. In addition to the usual features of such applicators the present applicators are provided with a scavenging or rinsing bore or duct in the nozzle body. The slide valve is adapted for the scavenging operation with an opening for connecting the scavenging duct to the adhesive supply conduit at predetermined points along the operational sequence of the slide valve. Normally the slide valve opens the adhesive discharge holes in one position and closes these holes in another position. According to the invention the slide is so arranged that it connects the adhesive supply conduit to the atmosphere in a third position for rinsing the adhesive supply conduit in said third position.

By repeatedly rinsing the adhesive supply conduit through the scavenging duct it is possible for any contaminating elements in the upper zone of the liquid adhesive to flow out of the nozzle body through the scavenging duct. Thus, these contaminations are prevented from clogging the adhesive discharge holes especially the upper holes. Accordingly, the adhesive is applied along the entire height or length of the narrow edge of a work piece without any trouble to thus assure a clean adhesive bond.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
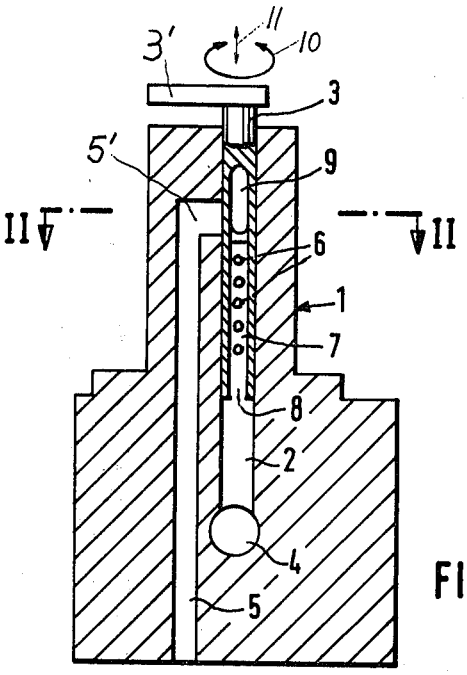
FIG. 1 is a sectional view substantially along the vertical axis of an adhesive applicator according to the invention.

FIG. 1 shows a sectional view through an adhesive applicator according to the invention having a nozzle body 1 provided with adhesive supply duct means 2 and 4, whereby the duct 2 simultaneously forms a bore for receiving a slide valve member 3 which is rotatable as indicated by the arrow 10 and axially slidable as indicated by the arrow 11. The rotational movement of the slide member 3 may be accomplished in a known manner by a piston cylinder arrangement, for example pneumatically operated, and connected with its piston rod to a lever arm 3' of the slide valve member 3. The axial adjustment may be accomplished manually by the operator for adjusting the glueing width to the height or thickness of the particular work piece.

The slide valve bore or adhesive duct 2 is connected to the adhesive supply duct 4 connected to the melting chamber not shown. According to the invention a scavenging duct 5 extends substantially in parallel to the bore 2 through the nozzle body 1 and reaches with its upper end 5' to a level above the adhesive discharge holes 6. The lower end of the scavenging duct 5 is connected to the atmosphere. The adhesive discharge holes 6 connect the bore 2 with a surface area 1' of the nozzle body 1 to thereby form an adhesive application surface along which the work pieces move in succession. The adhesive discharge holes 6 are arranged in a vertical row and the number of exposed holes 6 determines the width of the applicator surface 1' on the nozzle body 1.

Figure 2:
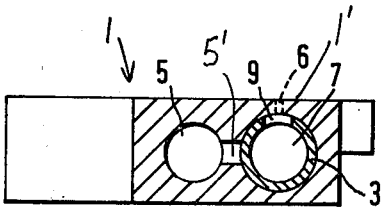
FIG. 2 is a sectional view along section line II—II in FIG. 1, whereby the slide valve is in a position for discharging adhesive through the respective holes.
Figure 3:
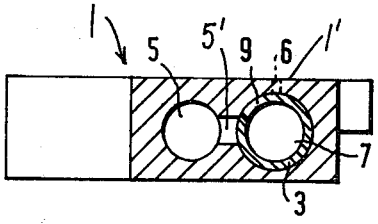
FIG. 3 is a view similar to that of FIG. 2, however showing the slide valve in a closed off position.
Figure 4:
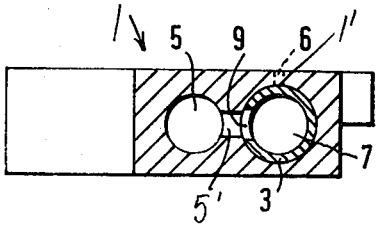
FIG. 4 is a view similar to that of FIG. 2 but showing the slide valve in the scavenging position.

As best seen in FIGS. 2, 3 and 4 the slide valve member 3 is preferably a tubular member provided with an internal channel 7 and an exit slot 8 shown in FIG. 1 as well as a scavenging slot 9.

FIG. 2 shows the slide valve member 3 in a first position, in which the adhesive discharge holes 6 are open and directly connected to the supply conduit 4 through the longitudinal channel 7 and through the discharge slot 8 in the slide valve member 3. Thus, adhesive may pass through the holes 6 onto the surface 1'. In this position the scavenging duct 5, 5' is closed by the slide valve member 3.

FIG. 3 shows the slide valve member 3 in a position in which the adhesive discharge holes 6 are closed off entirely from the adhesive supply conduit 4. Simulaneously the scavenging duct 5, 5' is also closed off.

FIG. 4 shows a position of the slide valve member 3 in which the scavenging duct 5, 5' is connected to the interior channel 7 of the slide member 3 for discharging or rinsing a small portion of adhesive with contaminants therein, through the rinsing slot 9 into the outwardly open rinsing or scavenging duct 5, 5'. Thus, any adhesive in the upper portion of the longitudinal channel 7 which contains contamination may be discharged into the open through the duct 5, 5'. The rinsing slot 9 is arranged in such a manner relative to the slot 8 that in the operational position of the rinsing slot 9, the adhesive discharge holes 6 are closed off as shown in FIG. 4.

Incidentally the control of the slide valve members 3 may be accomplished as is described in the above mentioned German Patent Publication (DE-OS) No. 27 31 799. The control may be accomplished through sensor switches actuated by the leading and trailing edge of the work piece. A further switch or switching element may be employed for determining the number of operations of the slide valve member 3 between each work stroke thereof or following several work strokes. In other words, the slide valve member 3 would assume a scavenging position as shown in FIG. 4 either between two work strokes or following a plurality of work strokes.

The duration of time during which the duct portion 5' is aligned with the scavenging opening 9 is so controlled that any waste of adhesive is minimized. For example, it has been found to be sufficient if only a single drop of liquid adhesive, which contains the contaminations, is discharged into the scavenging duct 5, 5' leading into the open atmosphere. Thus, only very small amounts of adhesive are lost.

The loss of adhesive may be further reduced by the above mentioned operation in which a scavenging action takes place only following several work or discharge actions. Besides, the loss of adhesive is minimized because the durations of aligning the opening 9 with the duct portion 5' is very short, for example only about 0.3 seconds.

The apparatus according to the invention, especially its scavenging features are particularly suitable for use in connection with applicators cooperating with a melting chamber in which the meltable adhesive is melted in the form of a cartridge or in the form of granular adhesive pressed in the melting chamber against a melting wall and through the melting wall toward the adhesive discharge holes or nozzles 6. However, it should be noted, that the present device is also suitable for adhesive of all types, including those, which are solid or liquid at room temperature and which are supplied directly to the work piece without any adhesive recirculation.

Although the invention has been described with reference to specific example embodiments, it will be appreciated, that it is intended to cover all modifications and equivalents within the scope of the appended claims.

What is claimed is:

1. An applicator for applying adhesive to work pieces, especially in an edge gluing machine through which the work pieces travel, comprising an upright nozzle body (1) having an upper end and a lower end, adhesive supply conduit means (2, 4) entering into said nozzle body (1) at its lower end and extending toward its upper end, adhesive discharge hole means (6) connecting said supply conduit means to an external adhesive applicator surface (1') intermediate the lower and upper ends of the nozzle body (1), slide valve means (3) slidably inserted in at least a portion of said supply conduit means (2) for opening said adhesive discharge hole means (6) to a desired extent in different positions of the slide valve means (3) and for closing said adhesive discharge hole means (6) in a further position of said slide valve means (3) which is operable from the outside of said nozzle body (1), and scavenging duct means (5, 5') operatively connected to said adhesive supply conduit means above said adhesive discharge hole means (6) in said nozzle body (1) for collecting contaminants above said adhesive discharge hole means (6) when said slide valve means separates said scavenging duct means from said supply conduit means, said slide valve means (3) having an opening (9) above said adhesive discharge hole means (6) for connecting said scavenging duct means (5, 5') to said supply conduit means (2, 4) when said slide valve means is in a third position for discharging from said supply conduit means a quantity of adhesive with contaminants collected therein into said scavenging duct means above said adhesive discharge hole means (6).

2. The applicator of claim 1, wherein said slide valve means is a hollow tubular member (3) having an external lever (3') for rotating said tubular member (3) in said supply conduit means (2) and for axially sliding said slide valve means (3) back and forth in said supply conduit means (2).

3. The applicator of claim 2, wherein said adhesive discharge hole means (6) in said nozzle body (1) and said opening (9) in said tubular slide valve member (3) are so located relative to each other that the opening (9) connects said scavenging duct means (5) to said supply conduit means (2, 4) each time when the slide valve means (3) is substantially in a position for closing said adhesive discharge hole means (6).

4. The applicator of claim 1 or 2, wherein said opening (9) in said slide valve means (3) is arranged for closing said opening (9) after said slide valve means (3) has passed repeatedly through a discharge hole (6) closing position.

5. The applicator of claim 1 or 2, wherein said slide valve means comprises a slot (8), said opening (9) being arranged in alignment with said slot (8) in said slide valve means, said scavenging duct means comprising a portion (5') positioned for alignment with said opening (9) when the slide valve means (3) are in a scavenging position in which said adhesive discharge hole means (6) are closed.

6. The applicator of claim 1, wherein said adhesive discharge hole means comprise a plurality of holes (6) arranged in a vertical row.

* * * * *